United States Patent [19]

Masaki et al.

[11] 4,012,905

[45] Mar. 22, 1977

[54] EXHAUST CLEANING SYSTEM FOR INTERNAL COMBUSTION ENGINE

[75] Inventors: Kenji Masaki, Yokohama; Hatuo Nagaishi; Mitinobu Konno, both of Yokosuka; Yoshio Ookubo, Yokohama, all of Japan

[73] Assignee: Nissan Motor Co., Ltd., Yokohama, Japan

[22] Filed: Aug. 12, 1974

[21] Appl. No.: 496,889

[30] Foreign Application Priority Data

Aug. 17, 1973 Japan ..... 48-92287
Aug. 17, 1973 Japan ..... 48-92288

[52] U.S. Cl. ..... 60/286; 60/289; 60/303; 60/306

[51] Int. Cl.[2] ..... F01N 3/14

[58] Field of Search ..... 60/286, 282, 289, 301, 60/306, 303

[56] References Cited

UNITED STATES PATENTS

| | | | |
|---|---|---|---|
| 2,944,399 | 7/1960 | McCardle | 60/39.72 R |
| 3,066,755 | 12/1962 | Diehl | 60/303 |
| 3,302,394 | 2/1967 | Pahnke | 60/323 |
| 3,756,027 | 9/1973 | Gotoh | 60/282 |
| 3,788,070 | 1/1974 | Camarasa | 60/282 |
| 3,826,089 | 7/1974 | Nakajima | 60/301 |
| 3,839,862 | 10/1974 | Gota | 60/282 |
| 3,872,666 | 3/1975 | Bentley | 60/301 |
| 3,872,667 | 3/1975 | Rosenlund | 60/282 |
| 3,927,525 | 12/1975 | Jacobs | 60/302 |

*Primary Examiner*—Douglas Hart

[57] ABSTRACT

An exhaust cleaning system for use with an automotive multiple-cylinder internal combustion engine including first and second groups of engine cylinders which are to be alternately fired, comprising a thermal reactor composed of an outer tubular structure formed with a first group of exhaust inlet ports leading from the first group of engine cylinders and a second group of exhaust inlet ports leading from the second group of engine cylinders, an inner tubular structure positioned within the outer tubular structure and formed with openings, and at least one air-injection nozzle opening in a longitudinal end portion of the interior or a re-combustion chamber of the inner tubular structure, wherein exhaust gases from each of the first group of engine cylinder are fired in the vicinity of the nozzle openings with the agency of secondary air injected from the nozzle and exhaust gases from each of the second group of engine cylinders are fired by the resultant hot gases advancing through a hot zone of the re-combustion chamber. Additional secondary air and/or secondary fuel may be admixed to the exhaust gases preferably during low-load condition of the engine when the temperature of the exhaust gases lowers.

37 Claims, 4 Drawing Figures

EXHAUST CLEANING SYSTEM FOR INTERNAL COMBUSTION ENGINE

The present invention relates to an exhaust cleaning system for use with an automotive multiple-cylinder internal combustion engine and, more particularly, to a vehicular exhaust cleaning system of the type using a thermal reactor which is adapted to re-combust exhaust gases of the engine so as to eliminate toxic combustible residues of hydrocarbons and carbon monoxide in the exhaust gases.

The thermal reactor of this type consists of coaxial inner and outer tubular structures which are radially spaced apart from each other so that a generally cylindrical space is formed between the structures. The exhaust gases emitted from the engine are directed together with secondary air into the inner tubular structure and are therein re-combusted with the agency of the secondary air. The resultant hot re-combusted gases are admitted into the cylindrical space between the inner and outer tubular structures through openings which are formed in the inner tubular structure. The inner tubular structure is thus heated by the hot re-combusted gases flowing over the outer peripheral surface of the inner tubular structure so that the gases being re-combusted in the inner tubular structure are constantly heated to the temperature ranging, say, from about 950° C to about 1100° C. The inner tubular structure is, thus, subjected to an extremely high temperature throughout the operation of the thermal reactor and, to enable the inner tubular member to withstand the heat for an extended period of time, it is important that the inner tubular structure be constructed of a highly heat-resistive material which is costly and messive. To protect the outer tubular structure from being broken or damaged by the heat, moreover, the outer tubular structure should also be formed of a highly heat-resistive massive material. Mounting the massive and heavy thermal reactor on the exhaust system of the engine would result in a failure of the engine to maintain the designed mechanical balance and the resistance to vibrations. The massive construction of the thermal reactor also gives rise to an increase in the thermal capacity of the reactor and, as a consequence, will be causative of loss of heat from the outer tubular structure, inviting a drop in the re-combustion efficiency of the thermal reactor. The degraded thermal efficiency of the reactor could be compensated for if the engine is so arranged as to operate on an enriched air-fuel mixture. It is, however, apparent that such an arrangement is objectionable from the view point of engine fuel economy. The present invention contemplates elimination of all these drawbacks inherent in the exhaust cleaning system of the described type.

It is accordingly, an important object of the present invention to provide an improved automotive exhaust cleaning system incorporating a thermal reactor which has a simply constructed, light-weight construction and which is nevertheless capable of completely re-combusting the exhaust gases of the engine with a sufficiently high temperature.

It is another important object of the invention to provide an improved automotive exhaust cleaning system which is adapted to completely eliminate the toxic combustible residues in the exhaust gases emitted from the engine and which will permit the engine to operate on a relatively lean air-fuel mixture which is advantageous for reducing the engine fuel consumption.

As will become apparent from the description to follow, the exhaust cleaning system according to the present invention is useful especially when combined with an automotive internal combustion engine of the multiple-cylinder type having, for example, four, six, eight, 12 or 16 cylinders of the in-line, V-type, X-type, or the like. In general, the internal combustion engine to be equipped with the exhaust cleaning system according to the present invention is assumed to include first and second groups of engine cylinders which are arranged to be fired alternately each other so that the engine cylinders of each of the groups is fired every second time.

In accordance with the present invention, there is provided an exhaust cleaning system which comprises a thermal reactor comprising an outer elongate hollow structure which is formed with a first group of exhaust inlet ports respectively in communication with the exhaust ports of the above mentioned first group of engine cylinders and a second group of exhaust inlet ports respectively in communication with the exhaust ports of the above mentioned second group of engine cylinders, an inner elongate hollow structure which is positioned within the outer elongate hollow structure for forming an elongate space between the outer and inner elongate hollow structures and which is formed with a plurality of openings providing communication between the elongate space between the outer and inner elongate hollow structures and the interior of the inner elongate hollow structure, the interior of the inner elongate hollow structure constituting a re-combustion chamber of the thermal reactor, at least one air-injection nozzle opening in the vicinity of one longitudinal end of the re-combustion chamber and in close proximity to an axis of the inner elongate hollow structure, the first group of exhaust inlet ports being open in the neighbourhood of the longitudinal end portion of the inner elongate hollow structure adjacent the above mentioned one longitudinal end of the re-combustion chamber, an outlet duct leading from the re-combustion chamber; and air-supply means for feeding air to the air-injection nozzle positioned in the re-combustion chamber.

The thermal reactor may further comprise guide means for guiding a stream of exhaust gases from each of the first group of exhaust inlet ports toward the aforesaid longitudinal end portion of the inner elongate hollow structure and a stream of exhaust gases from each of the second group of exhaust inlet ports toward an intermediate longitudinal portion of the inner elongate hollow structure. The guide means may comprise, in one preferred form, a partition member which is positioned in the elongate space between the outer and inner elongate hollow structures for dividing the elongate space into a first section communicating with the first group of exhaust inlet ports and with the re-combustion chamber through the openings located in the aforesaid longitudinal end portion of the inner elongate hollow structure and a second section communicating with the second group of exhaust inlet ports and with the re-combustion chamber through the opening located in the remaining longitudinal portion of the inner elongate hollow structure. In another preferred form, the guide means may comprise a passageway or duct which is in communication at one end with the first group of exhaust inlet ports and at the other end with the re-combustion chamber, the passageway opening either in that portion of the elongate space between the outer and inner elongate hollow structures which is located in the neighbourhood of the aforesaid longitudinal end portion of the inner elongate hollow structure or in the vicinity of the aforesaid one longitudinal end of the re-combustion chamber. In this instance, the guide means may further comprise a guide member positioned in the elongate space between the outer and inner elongate hollow structures and extending around the other longitudinal end portion of the inner elongate hollow structure so that the stream of the exhaust gases from each of the second group of exhaust inlet ports is guided over an outer peripheral surface of the guide member toward the intermediate longitudinal portion of the inner elongate hollow structure. As an alternative to such a guide member, a partition member may be positioned in the elongate space between the outer and inner elongate hollow structures for dividing the elongate space into a first section which is in communication with the above mentioned passageway and with the re-combustion chamber through the openings located in the aforesaid longitudinal end portion of the inner elongate hollow structure and a second section which is in communication with the second group of exhaust inlet ports and with the re-combustion chamber through the openings in the remaining longitudinal portion of the inner elongate hollow structure. The previously mentioned passageway may thus be open at its leading end in the first section of the elongate space above mentioned.

The air-supply means comprise an air-feed pump and an air-feed passageway leading from the air-feed pump and terminating in the air-injection nozzle in the re-combustion chamber. The air-supply means may further comprise a second air-feed passageway leading from the air-feed pump and opening in each of the exhaust ports of the previously mentioned first group of engine cylinders or, if desired, in each of the exhaust ports of all the engine cylinders, and valve means disposed in the second air-feed passageway and responsive to load on the engine so as to be operative to close the second air-feed passageway in response to an engine load higher than a predetermined level.

The exhaust cleaning system according to the present invention may further comprise fuel-supply means for admixing additional or "secondary" fuel to the exhaust gases to be re-combusted in the re-combustion chamber of the thermal reactor. The fuel-supply means may comprise a fuel-feed pump and a fuel-feed passageway leading from the fuel-feed pump and opening in each of the exhaust ports of the first group of engine cylinders or, if desired, in each of the exhaust ports of all the engine cylinders especially where the engine is adapted to operate on a relatively lean air-fuel mixture. The fuel-feed passageway may open, in lieu of the exhaust ports of the engine cylinders, in a mixture-forming chamber which may be provided between the air-supply means and the air-injection nozzle in the re-combustion chamber. Or otherwise, the fuel-feed passageway may open in the previously mentioned passageway leading from the first group of exhaust inlet ports in the outer elongate hollow structure. Valve means responsive to load on the engine may be disposed in the fuel-feed passageway so as to be operative to close the fuel-feed passageway in response to an engine load which is higher than a predetermined level.

The inner elongate hollow structure forming part of the thermal reactor may be composed of longitudinal halves which are separate from each other. In this instance, the halves of the inner elongate hollow structure may be supported by a support member which is in slidable contact with longitudinally inner end portions of the halves so that the halves may be longitudinally expansible by heat. The thermal reactor thus arranged may be provided with a pair of air-injection nozzles respectively opening in the vicinity of the longitudinally outer ends of the halves of the split inner elongate inner structure.

The exhaust cleaning system may further comprise heat-exchange means in contact with the outlet duct of the thermal reactor and located between the air-supply means and the air-injection nozzle in the re-combustion chamber for transferring heat from the re-combusted gases flowing through the outlet duct to air being fed to the air-injection nozzle. The heat exchange means may comprise a chamber which surrounds at least a portion of the outlet duct and which is in communication at one end with the air-supply means and at the other end with the air-injection nozzle in the re-combustion chamber.

Other features and advantages of the exhaust cleaning system according to the present invention will become apparent from the following description taken in conjunction with the accompanying drawings in which like reference numerals designate corresponding parts throughout the figures and in which.

Figure 1:
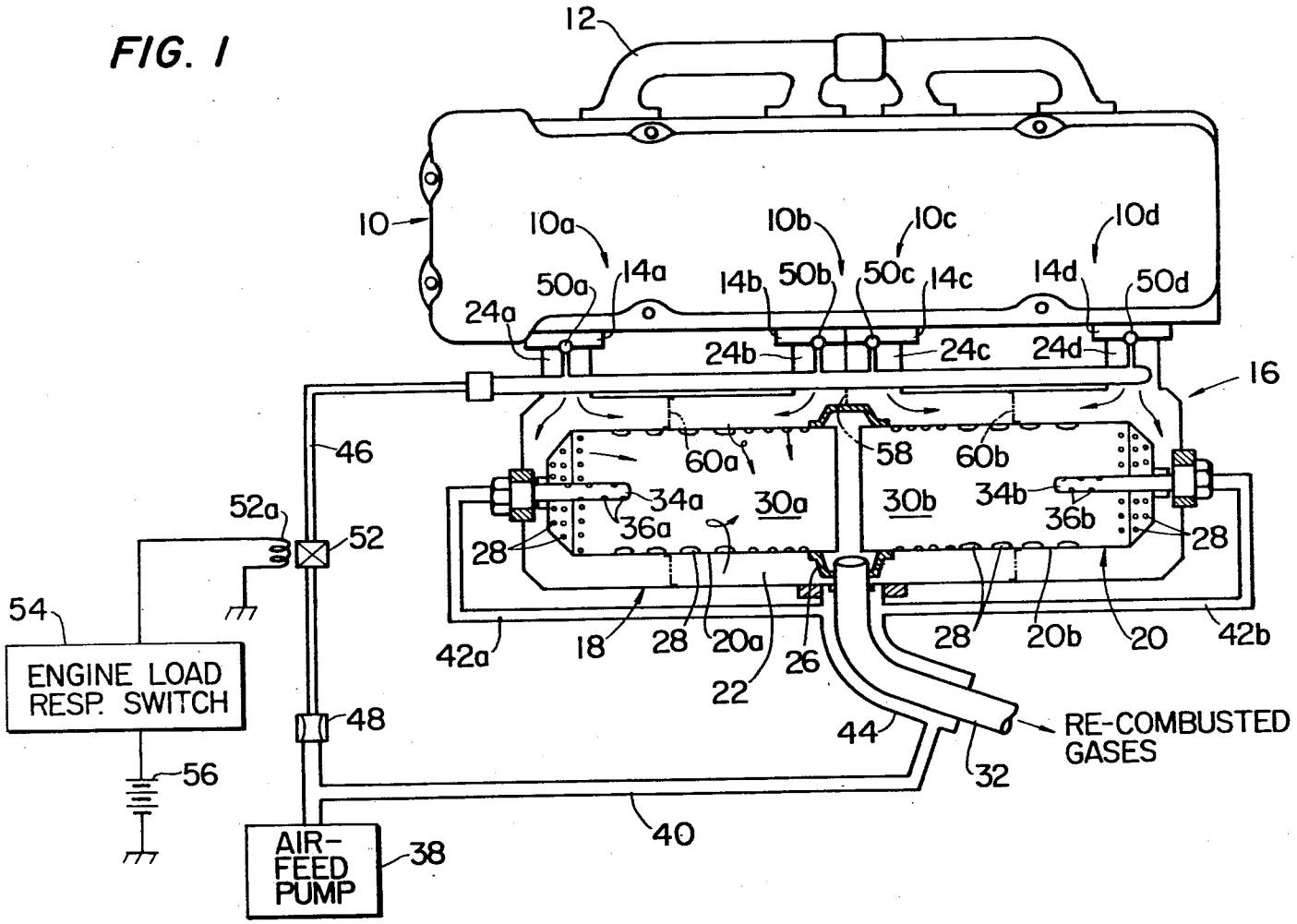
FIG. 1 is a schematic view showing, partly in section, a first preferred embodiment of the exhaust cleaning system according to the present invention.

Reference will now be made to the drawings, first to FIG. 1. In FIG. 1, the exhaust cleaning system embodying the present invention is shown as being combined with an automotive internal combustion engine 10 of the type having four cylinders 10*a*, 10*b*, 10*c* and 10*d* which will be herein referred to as first, second, third and fourth cylinders, respectively. As is customary in the art, the internal combustion engine 10 is provided with an intake manifold 12 connected to a mixture induction unit (not shown) such as a carburetor and an exhaust system which includes exhaust ports –*a*, 14*b*, 14*c* and 14*d* which lead from the engine cylinders 10*a*, 10*b*, 10*c* and 10 d, respectively.

The exhaust cleaning system comprises a thermal reactor 16 which consists of substantially coaxial outer and inner tubular structures 18 and 20, respectively, each of which is closed at both longitudinal ends. The outer and inner tubular structures 18 and 20 have coextensive longitudinal wall portions which are radially spaced apart from each other so that a generally cylindrical space is formed between the wall portions as indicated at 22. The outer and inner tubular structures 18 and 20 are, furthermore, shown to have their respective closed longitudinal ends spaced apart from each other so that spaces are formed between the longitudinal end wall portions of the tubular structures 18 and 20. The outer tubular structure 18 is formed with exhaust inlet ports 24*a*, 24*b*, 24*c* and 24*d* which are open to the cylindrical space 22 between the outer and inner tubular structures 18 and 20 and which are in constant communication with the exhaust ports 14*a*, 14*b*, 14*c* and 14*d* of the engine cylinders 10*a*, 10*b*, 10*c* and 10*d*, respectively. The inner tubular structure 20 is composed of halves 20*a* and 20*b* which are longitudinally spaced apart from each other at the longitudinal center of the outer tubular structure 18 and which have respective longitudinal open ends. The halves 20*a* and 20*b* of the inner tubular structure 20 are supported at their longitudinally inner end portions by a generally ring-shaped support member 26 which is in slaidable contact with the outer peripheral surfaces of the inner end portions of the halves 20*a* and 20*b*. Each of the halves 20*a* and 20 *b* of the inner tubular structure 20 is formed with a number of openings 28 which are evenly distributed throughout the longitudinal wall portion and the end wall portion of the half. Communication is thus provided through these openings 28 between the space between the outer and inner tubular members 18 and 20 and the interior of the inner tubular structure 20, the interior of the inner tubular structure 20 constituting re-combustion chambers 30*a* and 30*b* which are formed in the halves 20*a* and 20*b*, respectively, of the structure 20. Of the openings 28 thus formed in the inner tubular structure 20, those in the end wall portions and the longitudinally outer end portions of the halves 20*a* and 20*b* are located in the vicinity of the exhaust inlet ports 14*a* and 14*d* of the outer tubular structure 18 and those in the longitudinally inner end portions of the halves 20*a* and 20*b* are located in the vicinity of the exhaust inlet ports 14*b* and 14*c* of the outer tubular structure 18, as shown. The thermal reactor 16 further comprises an exhaust outlet duct 32 which is open at one end adjacent the longitudinally inner open ends of the halves 20*a* and 20*b* of the inner tubular structure 20 and which projects outwardly of the outer tubular structure 18. The exhaust outlet duct 32 is connected at its leading end to an exhaust pipe which is vented to the atmosphere through a muffler or mufflers and a tail pipe, though not shown in the drawing.

A pair of air-injection nozzles 34*a* and 34*b* projects through the longitudinal outer end wall portions of the outer and inner tubular structures 18 and 20 into the re-combustion chambers 30*a* and 30*b* of the halves 20*a* and 20*b*, respectively, of the inner tubular structure 20. The air-injection nozzles 34*a* and 34*b* are formed with openings 36*a* and 36*b*. respectively. An air-feed pump 38 is usually driven by the crankshaft (not shown) of the engine 10 and has a discharge port communicating through a passageway 40 and branch passageways 42*a* and 42*b* with the air-injection nozzles 34*a* and 34*b*. The air-feed passageway 40 is shown to be connected to the branch passageways 42*a* and 42*b* through an air jacket 44 which surrounds part of the exhaust outlet duct 32 for the purpose of providing heat exchange means adapted to exchange heat between the hot gases to flow in the duct 32 and the fresh air to be passed through the air jacket 44. The passageway 40 leading from the air-feed pump 38 is further branched to a passageway 46 through a restriction 48. The passageway 46 terminates in air-injection nozzles 50*a*, 50*b*, 50*c* and 50*d* which project into the exhaust ports 14*a*, 14*b*, 14*c* and 14 *d* of the engine cylinders 10*a*, 10*b*, 10*c* and 10*d*, respectively. In the passageway 46 is disposed a solenoid-operated valve 52 which is adapted to close the passageway 46 when de-energized and to open the passageway 46 when energized. The solenoid-operated valve 52 has a coil 52*a* which is connected across an engine-load responsive switch 54 to a d.c. power source 56 which is usually the engine loaded battery. The engine-load responsive switch 54 is biased to open and is operative to close responsive to an engine load lower than a predetermined level.

When, now, the engine 10 is in operation, the exhaust gases containing combustible residues of hydrocarbons and carbon monoxide emitted from the engine cylinders 10*a*, 10*b*, 10*c* and 10*d* are discharged from the exhaust ports 14*a*, 14*b*, 14*c* and 14*d* of the cylinders into the exhaust inlet ports 24*a*, 24*b*, 24*c* and 24*d*, respectively, of the thermal reactor 16 and, through these exhaust inlet ports 24*a* to 24*d*, enter the space 22 between the outer and inner tubular structures 18 and 20. The stream of the exhaust gases entering the space 22 from the exhaust inlet port 24*a* leading from the first engine cylinder 10*a* or the exhaust inlet port 24*d* leading from the fourth engine cylinder 10*d* is admitted into the re-combustion chamber 30*a* or 30*b* through the openings 28 in the end wall portion and the longitudinally outer end portion of the half 20*a* or 20*b* of the inner tubular structure 20. On the other hand, the stream of the exhaust gases entering the space 22 from the exhaust inlet port 24*b* leading from the second engine cylinder 10*b* or the exhaust inlet port 24*c* leading from the third engine cylinder 10*c* is admitted to the re-combustion chamber 30*a* and 30*b* through the openings 28 in the longitudinally inner end portion of the half 20*a* or 20*b* of the inner tubular structure 20. The exhaust gases thus admitted into the re-combustion chamber 30*a* through the openings 28 from the exhaust inlet port 24*a* associated with the first engine cylinder 10*a* during the exhaust cycle of the cylinder 10*a* is mixed with the secondary air injected into the re-combustion chamber 30*a* from the openings 36*a* in the air-injection nozzle 34*a*. The resultant mixture of the exhaust gases and the secondary air is fixed by the heat possessed by the exhaust gases in the neighbourhood of the air-injection nozzle 34*a*. Hot turbulent flows of combusted gases containing an excess of air are consequently induced around the air injection nozzle 34*a* and advance in the re-combustion chamber 30*a* toward the longitudinal open end of the half 20*a* of the inner tubular structure 20. The oxidizing reaction between the combustible compounds initially contained in the exhaust gases and the secondary air thus proceeds as the hot turbulent flows of the combusted gases approach the open end of the half 20*a* of the inner tubular structure 20, viz., the longitudinal central zone of the interior of the inner tubular structure 20. This longitudinal central zone in the interior of the inner tubular structure 20 is herein referred to as the "hot zone" of the thermal reactor 16 because the temperature of the combusted gases in the reactor peaks up in this particular zone. As the hot combusted gases resulting from the mixture of the exhaust gases from the exhaust inlet port 24*a* and the secondary air are thus flowing through this hot zone in the re-combustion chamber 30*a*, another stream of exhaust gases enters the space 22 between the outer and inner tubular structures 18 and 20 through the exhaust inlet port 24*b* leading from the exhaust port 14*b* of the second engine cylinder 10*b* which is now in its exhaust cycle. The exhaust gases are admitted into the re-combustion chamber 30*a* through the openings 28 located in the longitudinally inner end portion of the half 20*a* of the inner tubular structure 20. The exhaust gases thus newly admitted into the re-combustion chamber 30*a* are mixed with the hot combusted gases flowing through the hot zone of the combustion chamber 30*a* and are re-combusted by the heat of the hot combusted gases with the agency of the excess of air contained in the hot combusted gases. The exhaust gases which have been thus cleared of the combustible compounds of hydrocarbons and carbon monoxide initially contained in the exhaust gases are discharged to the open air through the exhaust outlet duct 32. The re-combustion of the exhaust gases entering the re-combustion chamber 30*b* in the other half 20*b* of the inner tubular structure 20 from the exhaust inlet ports 24*d* and 24*c* leading from the exhaust ports 14*d* and 14*c* of the fourth and third engine cylinders 10*d* and 10*c* in this sequence is effected in similar manners.

If, thus, the firing order of the engine cylinders 10*a*, 10*b*, 10*c* and 10*d* is determined in such a manner that the first, second, fourth and third cylinders 10*a*, 10*b*, 10*d* and 10*c* are actuated into power strokes in this sequence during each cycle of operation of the engine 10 as is usual in four-cylinder engines, the exhaust gases are directed from the exhaust port 14*a* or 14*d* of the first or fourth engine cylinder 10*a* or 10*d* into the re-combustion chamber 30*a* or 30*b* and thus produce hot combusted gases in the longitudinally outer end portion of the re-combustion chamber during former part of the former or latter half of each cycle of the engine operation and, thereafter, the exhaust gases are directed from the exhaust port 14*b* or 14*c* of the second or third engine cylinder 10*b* or 10*c* into the re-combustion chamber 30*a* or 30*b* and are admixed to and fired by the heat of the previously produced hot combusted gases flowing in the hot zone of the recombustion chamber during the remaining part of the former or latter half of the cycle of the engine operation. If, desired, in this instance, an annular partition member 58 may be positioned around the annular support member 26 as indicated by a phantom line in FIG. 1 so that the space 22 between the outer and inner tubular structures 18 and 20 is divided by the partition member 58 into longitudinally separate halves. The stream of the exhaust gases leading the exhaust inlet port 24*b* or 24*c* leading from the second or third engine cylinder 10*b* or 10*c* is thus prevented from entering the re-combustion chamber 30*b* or 30*a*, respectively, by means of the partition member 58 and is directed with certainty into the re-combustion chamber 30*a* or 30*b*, respectively. Additional annular partition members 60*a* and 60*b* may be further provided, each of which members is positioned in each of the longitudinally separate halves of the space 22 so that each of the halves is further divided into longitudinally separate sections which are respectively in communication with the exhaust inlet ports 24*a* and 24*b* leading from the first and second engine cylinders 10*a* and 10*b* or the exhaust inlet ports 24*c* and 24*d* leading from the third and fourth engine cylinders 10*c* and 10*d*. Where the partition members 58, 60*a* and 60*b* are thus positioned in the space 22, the space 22 is divided into a total of four longitudinally separate sections which are respectively in communication with the exhaust inlet ports 24*a*, 24*b*, 24*c* and 24*d* connected to the first, second, third and fourth engine cylinders 10*a*, 10*b*, 10*c* and 10*d* and, at the same time, with the openings 28 in the inner tubular structure 20 form four different groups which are respectively associated with the four sections of the space 22. As a consequence, the exhaust gases entering the re-combustion chamber 30*a* or 30*b* from each of the exhaust inlet ports 24*a*, 24*b*, 24*c* and 24*d* are distributed in a localized region within the re-combustion chamber and will thus contribute to raising the combustion efficiency of the thermal reactor 16. The re-combusted gases discharged from the thermal reactor 16 are effective to heat the air jacket 44 when the re-combusted gases are flowing through the exhaust outlet duct 32 surrounded by the air jacket 44 so that the duct 32 is cooled down and at the same time the fresh air flowing through the air jacket 44 is warmed up by reason of the heat exchanged between the re-combusted gases and the fresh air. Warmed secondary air is thus injected into the combustion chambers 30*a* and 30*b* from the air-injection nozzles 34*a* and 34*b*, respectively. This wall also contribute to increasing the combustion efficiency of the thermal reactor 16.

During low-load condition of the engine, the temperature of the exhaust gases emitted from the engine cylinders is reduced so that the exhaust gases entering the combustion chambers 30*a* and 30*b* might fail to be fired. When, thus, the engine load is reduced below a predetermined level, then the engine-load responsive switch 54 closes so that the coil 52*a* of the solenoid-operated valve 52 is energized from the d.c. power source 38. The solenoid-operated valve 52 is thus actuated to open the passageway 46 leading from the air-feed pump 38 through the restriction 48 so that the secondary air is fed not only to the air-injection nozzles 34*a* and 34*b* of the thermal reactor 16 but through the passageway 46 to the air-injection nozzles 50*a*, 50*b*, 50*c* and 50*d* opening into the exhaust ports 14*a*, 14*b*, 14*c* and 14*d* of the engine cylinders 10*a*, 10*b*, 10*c* and 10*d*, respectively. The exhaust gases spurting out of the exhaust ports 14*a*, 14*b*, 14*c* and 14*d* of the engine cylinders are mixed with the secondary air injected from each of the air-injection nozzles 50*a*, 50*b*, 50*c* and 50*d* when the exhaust gases are entering and passing through the associated one of the exhaust inlet ports 24*a*, 24*b*, 24*c* and 24*d* of the thermal reactor 16. The resultant mixture of the exhaust gases and the secondary air thus admixed thereto is partly burned when flowing through the exhaust inlet port and the space 22, or one of the longitudinally separate sections of the space 22 if the previously mentioned partition members 58, 60*a* and 60*b* are provided in the space 22. The partly burned mixture is then admitted into the combustion chamber 30*a* or 30*b* through the openings 28 in the inner tubular structure 20 and is further mixed with either the secondary air from the air-injection nozzle 34*a* or 34*b* or the hot combusted gases flowing in the hot zone of the re-combustion chamber 30*a* or 30*b*. The temperature of the gases to be combusted in the re-combustion chamber 30*a* or 30*b* is maintained at a sufficiently high level throughout the low-load condition of the engine because the total volume of the gases entering the re-combustion chamber 30*a* or 30*b* from each of the exhaust inlet ports 24*a*, 24*b* 24*c* and 24*d* is increased by the secondary air preliminarily admixed to the exhaust gases with consequent enhancement of the turbulence of the flows induced in the combustion chamber and because of the fact that the rate of ejection of the secondary air from the nozzles 34*a* and 34*b* is reduced with part of the pumped air branched to the passageway 46 so that the preliminarily burned mixture of the exhaust gases and the secondary air is prevented from excessively cooled and diluted with the secondary air in the re-combustion chamber 30*a* or 30*b*. Where desired, the air-injection nozzles 50*b* and 50*c* may be removed from the exhaust ports 14*b* and 14*c* of the second and third engine cylinders 10*b* and 10*c* so that only the exhaust ports 14*a* and 14*d* of the first and fourth engine cylinders 10*a* and 10*d* are provided with the air-injection nozzles 50*a* and 50*d*, respectively, which are in communication with the passageway 46. In this instance, the exhaust gases entering the re-combustion chamber 30*a* or 30*b* from the exhaust port 14*b* or 14*c* of the second or third engine cylinder 10*b* or 10*c*, respectively, will be lower in temperature than the partly burned mixture entering the re-combustion chamber from the exhaust port 14*a* or 14*d* of the first or fourth engine cylinder 10*a* or 10*d* and will contain a combustible contact which is higher in concentration than the mixture from the exhaust port 14*a* or 14*d*. The exhaust gases thus admitted into the re-combustion chamber 30*a* or 30*b* are mixed with the preliminarily partly burned mixture from the exhaust port 14*a* or 14*d* and are completely re-combusted by the heat of the hot combusted gases in the hot zone.

The cylinders 10*a* to 10*d* of the engine 10 have thus far been assumed to be fired in the sequence of the first, second, fourth and third cylinders 10*a*, 10*b*, 10*d* and 10*c*, respectively, in each cycle of operation of the engine. If desired, however, the firing order of the engine cylinders 10*a* to 10*d* may be altered so that the first, third fourth and second cylinders 10*a*, 10*c*, 10*d* and 10*b* are fired in this sequence. Where the engine 10 is arranged to have such a firing order, the exhaust gases from the exhaust port 14*c* or 14*b* of the third or second engine cylinder 10*c* or 10*b* will be admitted into the re-combustion chambers 30*a* and 30*b* partly through the openings 28 in one half 20*a* of the inner tubular structure 20 and partly through the openings 28 in the other half 20*b* of the inner tubular structure 20 and fired in the combustion chambers 30*a* and 30*b* partly by the hot combusted gases resulting from the exhaust gases admitted into the re-combustion chamber 30*a* from the exhaust port 14*a* of the first engine cylinder 10*a* and partly by the hot combusted gases resulting from the exhaust gases admitted into the re-combustion chamber 30*b* from the exhaust port 14*d* of the fourth engine cylinder 10*d*. In this instance, it will be apparent that the previously mentioned partition member 58 should not be positioned in the space 22. If desired, however, the exhaust inlet ports 24*b* and 24*c* of the thermal reactor 16 connected to the exhaust ports 14*b* and 14*c* of the second and third engine cylinders 10*b* and 10*c*, respectively, may be so oriented or inclined toward the longitudinally inner end portions of the halves 20*b* and 20*a*, respectively, of the inner tubular member 20 so that the effect similar to that achieved through provision of the previously mentioned partition member 58 may be attained.

As is well known in the art, the thermal reactors for use with the automotive internal combustion engines are, in general, adapted to re-oxidize carbon monoxide rather than hydrocarbons. For the purpose of completely eliminating the carbon monoxide in the vehicular exhaust gases, therefore, it is desirable that the reaction atmosphere in the thermal reactor be maintained at a sufficiently high level and that the exhaust gases contain carbon monoxide in an increased concentration. For this reason, it is preferable that the internal combustion engine 10 equipped with the thermal reactor 16 of the nature thus far described is so arranged that the first and fourth cylinders 10*a* and 10*d* are supplied with an air-fuel mixture having an air-to-fuel ratio lower than the known theoretical value and the second and third cylinders 10*b* and 10*c* supplied with an air-fuel mixture having an air-to-fuel ratio higher than the theoretical value. As is well known, the exhaust gases produced by the combustion of the air-fuel mixture having an air-to-fuel ratio lower than the theoretical value, viz., richer than the mixture having the theoretical air-to-fuel ratio contain carbon monoxide of a relatively high concentration and hydrocarbons of a relatively low concentration, whereas the exhaust gases resulting from the combustion of the air-fuel mixture having an air-to-fuel ratio higher than the theoretical value, vis., leaner than the mixture having the theoretical air-to-fuel ratio contain carbon monoxide of a relatively low concentration and hydrocarbons of a relatively high concentration. When the internal combustion engine 10 thus arranged is in operation, therefore, the exhaust gases containing the carbon monoxide of the relatively high concentration and the hydrocarbons of the relatively low concentration are to be re-combusted in the longitudinally outer end portion of the combustion chamber 30*a* or 30*b*. The temperature of the re-combusted gases thus produced will be high enough to have the carbon monoxide completely oxidized because of the relatively large proportion of the combustible content in the gases being re-combusted. The resultant hot combusted gases are then mixed in the re-combustion chamber 30*a* or 30*b* with the exhaust gases admitted into the combustion chamber from the second or third engine cylinder 10*b* or 10*c* and containing the carbon monoxide of the relatively low concentration and the hydrocarbons of the relatively high concentration. Because of the sufficiently high temperature of the hot combusted gases in the hot zone and because of the relatively low concentration of the carbon monoxide in the exhaust gases emitted from the second or third engine cylinder 10*b* or 10*c*, the combustible residues in the exhaust gases admixed to the hot combusted gases will be completely oxidized.

As is also well known in the art, the concentration of nitrogen oxides which are other important pollutants contained in the vehicular exhaust gases becomes maximal when the air-fuel mixture supplied to the engine is proportioned to the theoretical air-to-fuel ratio. The above described arrangement of the engine 10 will thus be conductive not only to elimination of the carbon monoxide and hydrocarbons but to reduction of the toxic nitrogen oxides because the air-fuel mixture supplied to the engine has an air-to-fuel ratio which is lower or higher than the theoratical value. It may be mentioned that, where the engine 10 is so arranged that the second and third cylinders 10*b* and 10*c* operate on the leaned air-fuel mixture as above described, it is preferable that the air-injection nozzles 50*b* and 50*c* be removed from the exhaust ports 14*b* and 14*c* of the second and third engine cylinders 10*b* and 10*c* for the purpose of preventing the exhaust gases from the engine cylinders 10*b* and 10*c* from being excessively diluted with the secondary air.

Figure 2:
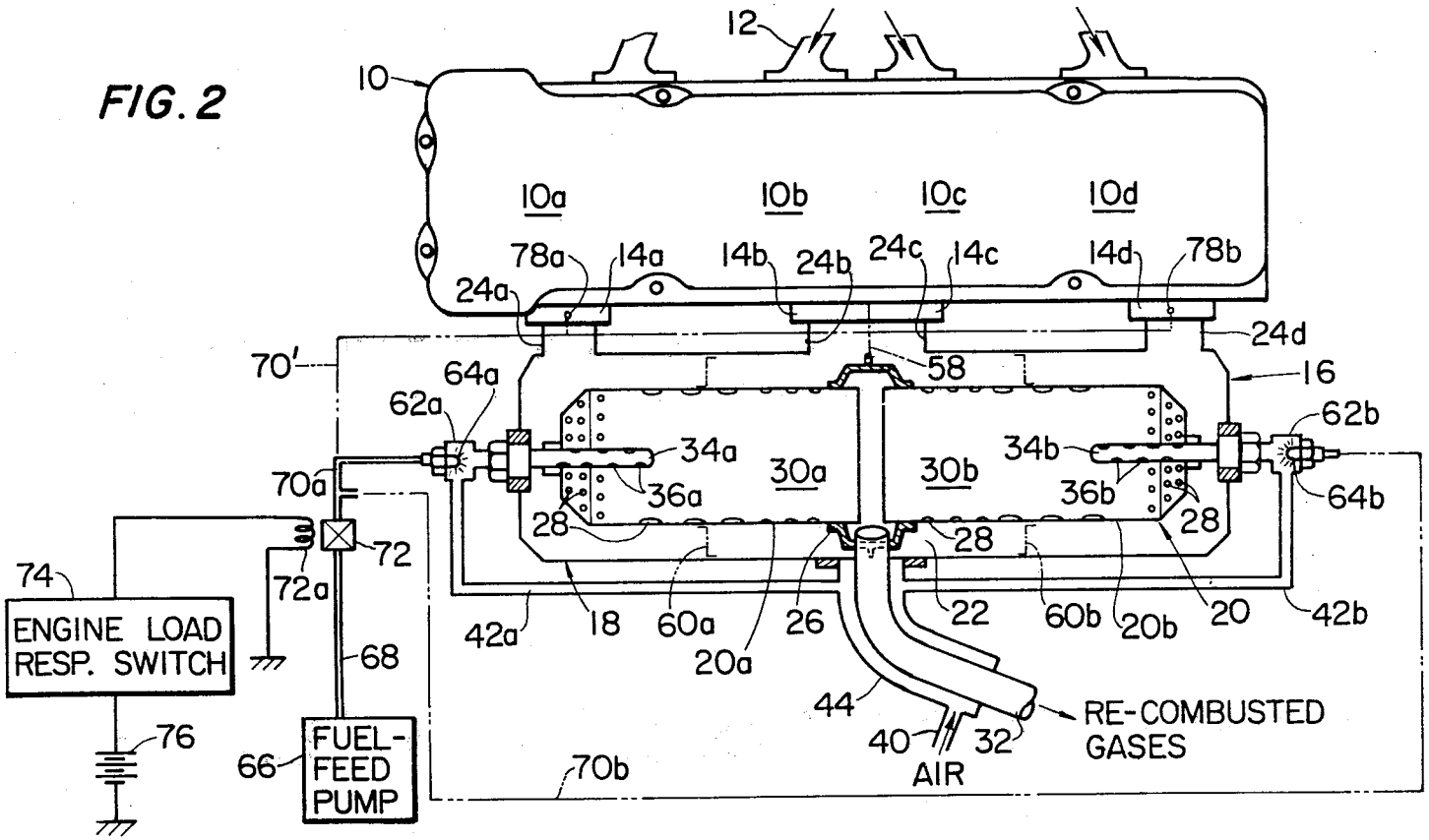
FIG. 2 is a schematic view showing, partly in section, a second preferred embodiment of the exhaust cleaning system according to the present invention.

As an alternative to the above described engine arrangement in which the engine cylinders operate on the air-fuel mixtures having the different air-to-fuel ratios, arrangement may be made so that an additional or "secondary" fuel is supplied to the thermal reactor 16. FIG. 2 illustrates the exhaust cleaning system including such an arrangement, the arrangement being however adapted to be operative only during low-load condition of the engine when the temperature of the exhaust gases is reduced.

Referring to FIG. 2, the exhaust cleaning system comprises a thermal reactor 16 which is constructed essentially similarly to its counterpart incorporated into the embodiment illustrated in FIG. 1, the corresponding parts and structures of the reactor being therefore designated by the same reference numerals and characters as those which have been used in FIG. 1. The thermal reactor 16 of the exhaust cleaning system illustrated in FIG. 2 is also assumed to be combined with a four-cylinder internal combustion engine 10 which consists of first, second, third and fourth cylinders 10*a*, 10*b*, 10*c* and 10*d*. The internal combustion engine 10 to be combined with the second embodiment of the exhaust cleaning system according to the present invention is, however, further assumed to be so arranged as to be operable on a relatively lean air-fuel mixture. The exhaust cleaning system illustrated in FIG. 2 is, thus, provided with a secondary-air supply arrangement which is adapted to supply secondary air only to the re-combustion chambers 30*a* and 30*b* of the thermal reactor 16, including no such means as to be operative to feed the secondary air to the exhaust ports 14*a*, 14*b*, 14*c* and 14*d* of the engine cylinders 10*a*, 10*b*, 10*c* and 10*d*. The secondary air is supplied from a suitable air-feed pump (not shown) and is fed through the passageway 40, the air jacket 44 and the branch passageways 42*a* and 42*b* to the nozzles 34*a* and 34*b* which have openings 36*a* and 36*b*, respectively, located in the longitudinally outer end portions of the combustion chambers 30*a* and 30*b*, as previously described in connection with the embodiment illustrated in FIG. 1.

At the inlets of the nozzles 34*a* and 34*b* from the above mentioned branch passageways 42*a* and 42*b* are disposed mixture-forming chambers 62*a* and 62*b*, into which fuel-injection nozzles 64*a* and 64*b* project respectively. An engine-driven fuel-feed pump 66 has a discharge port communicating with a fuel-feed passageway 68 which, in turn, is in communication with branch passageways 70*a* and 70*b* across a solenoid-operated valve 72. The branch passageways 70*a* and 70*b* terminate in the fuel-injection nozzles 64*a* and 64*b*, respectively, so that the secondary fuel delivered from the fuel-feed pump 66 is injected into the mixtureforming chambers 62*a* and 62*b* from the fuel injection nozzles 64*a* and 64*b* if and when the solenoid-operated valve 72 is open. The solenoid-operated valve 72 is arranged essentially similarly to the solenoid-operated valve 52 of the secondary-air supply arrangement of the system illustrated in FIG. 1 and is thus adapted to close the passageway 68 when de-energized and to open the passageway 68 when energized. The solenoid-operated valve 72 has a coil 72*a* which is connected over an engine-load responsive switch 74 to a d.c. power source 76. The engine-load responsive switch 74 is also arranged similarly to its counterpart of the secondary-air supply arrangement of the system shown in FIG. 1 and is thus adapted to be biased into an open position and to close in response to an engine load lower than a predetermined level.

When the engine 10 is operating in usual conditions, the exhaust gases emitted from the engine 10 are re-combusted in the re-combustion chambers 30*a* and 30*b* of the thermal reactor 16 with the agency of the secondary air injected from the nozzles 34*a* and 34*b* in manners which have been described in detail in connection with the embodiment illustrated in FIG. 1. Under these conditions, the engine-load responsive switch 74 is kept closed and accordingly the solenoid-operated valve 72 is maintained de-energized so that no additional or "secondary" fuel is admixed to the secondary air being injected from the nozzles 34*a* and 34*b* into the re-combustion chambers 30*a* and 30*b*.

When, however, the engine is operating at low load, the engine-load responsive switch 74 is closed so that the coil 72*a* of the solenoid-operated valve 72 is energized from the d.c. power source 76. The solenoidoperated valve 72 is consequently actuated to open the fuel-feed passageway 68 so that the secondary fuel is injected into the mixture-forming chambers 62*a* and 62*b* from the fuel injection nozzles 64*a* and 64*b*, respectively. The fuel is atomized in the mixture-forming chambers 62*a* and 62*b* and is mixed with air directed into the chambers through the air-feed passageways 42*a* and 42*b*. The mixture of the fuel and air is injected from the nozzles 34*a* and 34*b* into the recombustion chambers 30*a* and 30*b*. The air-fuel mixture injected into the re-combustion chamber 30*a* from the nozzle 34*a* is fired by the heat possessed by the exhaust gases which are admitted into the longitudinally outer end portion of the re-combustion chamber 30*a* from the exhaust inlet port 24*a* leading from the first engine cylinder 10*a* and, likewise, the air-fuel mixture injected into the re-combustion chamber 30*b* from the nozzle 34*b* is fired by the heat of the exhaust gases admitted into the longitudinally outer end portion of the re-combustion chamber 30*b* from the exhaust inlet port 24*d* leading from the fourth engine cylinder 10*d*. The turbulent flows of the resultant hot combusted gases advance toward the previously mentioned hot zone in the inner tubular structure 20 and fire the exhaust gases which are then admitted into the combustion chamber 30*a* or 30*b* from the exhaust inlet port 24*b* or 24*c* leading from the second or third engine cylinder 10*b* or 10*c*, respectively. The exhaust gases discharged from the engine cylinders during low-load condition of the engine 10 are thus reliably fired and efficiently re-combusted in the thermal reactor 16 by reason of the flame zones produced around the nozzles 34*a* and 34*b* in the re-combustion chambers 30*a* and 34*b*, even though the temperature of the exhaust gases and the concentration of the carbon monoxide in the exhaust gases may be reduced during the low engine-load condition. Because, moreover, of the fact that the engine cylinders 10*a* to 10*d* are supplied with a relatively lean air-fuel mixture which has an air-to-fuel ratio higher than the theoretical value as previously mentioned, not only hydrocarbons and carbon monoxide in the exhaust gases can be efficiently reoxidized but the exhaust gases will contain nitrogen oxides in a reduced concentration.

The secondary fuel has thus far been assumed to be admixed in the form of a mixture with secondary fuel to the exhaust gases in the re-combustion chambers 30*a* and 30*b*. If desired, however, the fuel may be injected into the exhaust port 14*a* and 14*d* of the first and fourth engine cylinders 10*a* through provision of fuel injection nozzles 78*a* and 78*b* projecting into the exhaust ports 14*a* and 14*d* and communicating through a fuel-feed passageway 70′ with the fuel-feed pump 66 across the solenoid-operated valve 72. In this instance, the exhaust ports 14*a* and 14*d* of the first and fourth engine cylinders 10*a* and 10*d* may be further provided with air-injection nozzles (not shown) which are in communication with the air-feed pump through an air supply arrangement including, for example, the passageway 46 with the restriction 48, the solenoid-operated valve 52 and the engine-load responsive switch 54 forming part of the embodiment of the exhaust cleaning system illustrated in FIG. 1.

A third preferred embodiment of the exhaust cleaning system illustrated in FIG. 1.

Figure 3:
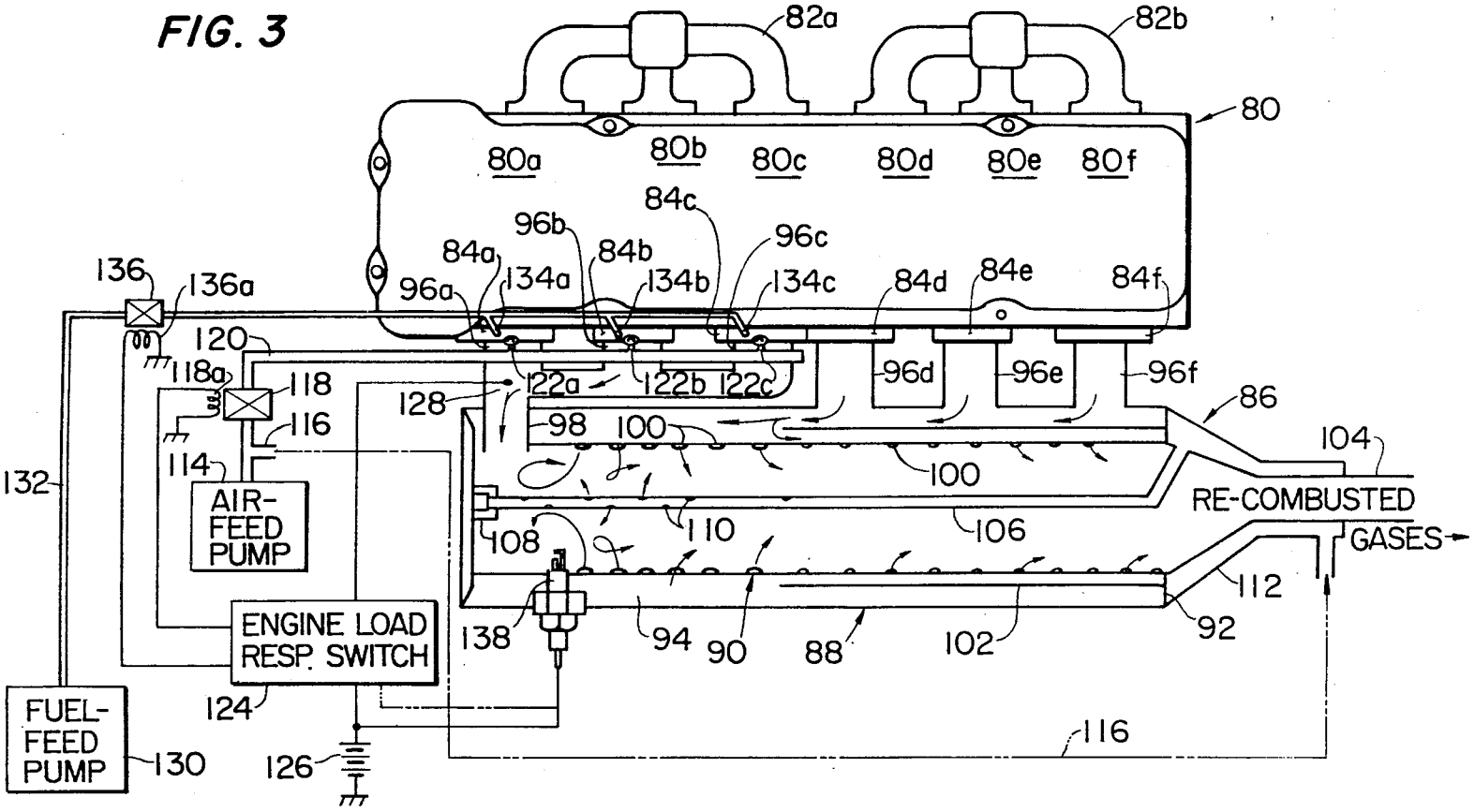
FIG. 3 is a schematic view showing, partly in section, a third preferred embodiment of the exhaust cleaning system according to the present invention.

A third preferred embodiment of the exhaust cleaning system according to the present invention is now illustrated in FIG. 3. The exhaust cleaning system herein shown is exemplified as being combined with a six-cylinder internal combustion engine 80 which consists of first, second, third, fourth, fifth and sixth cylinders 80*a*, 80*b*, 80*c*, 80*d*, 80*e* and 80*f*, respectively. The six-cylinder internal combustion engine 80 has intake manifold 82*a* and 82*b* connected to a mixture induction unit such as a cerburetor (not shown), and an exhaust system which includes exhaust ports 84*a*, 84*b*, 84*c*, 84*d*, 84*e* and 84*f* leading from the engine cylinders 80*a*, 80*b*, 80*c*, 80*d*, 80*e* and 80*f*, respectively.

The exhaust cleaning system combined with the six-cylinder internal combustion engine 80 thus arranged comprises a thermal reactor which is designated in its entirety by reference numeral 86. The thermal reactor 86 is composed of substantially coaxial outer and inner tubular structures 88 and 90, of which the outer tubular structure 88 is closed at one end by an end wall portion of the structure 88 and at the other end by an annular wall member 92 surrounding the inner tubular structure whereas the inner tubular structure 90 is closed at one end by an end wall portion of the inner tubular member and open at the other end. The outer and inner tubular structures 88 and 90 have co-extensive longitudinal wall portions which are radially spaced apart from each other so that a generally cylindrical space 94 is formed therebetween, the cylindrical space extending between the closed end wall portion of the outer tubular structure 88 and the annular wall member 92. The outer tubular structure 88 is formed with exhaust inlet ports 96*a*, 96*b*, 96*c*, 96*d*, 96*e* and 96*f* which are in communication with the exhaust ports 84*a*, 84*b*, 84*c*, 84*d*, 84*e* and 84*d* of the first, second, third, fourth, fifth and sixth cylinders 80*a*, 80*b*, 80*c*, 80*d*, 80*e* and 80*f*, respectively, of the engine 80. The ports 96*a* to 96*f* consist of a first group consisting of the ports 96*a*, 96*b* and 96*c* communicating with the interior of the inner tubular structure 90 through a common exhaust inlet duct 98 and a second group of ports 96*d*, 96*e* and 96*f* which are open to the cylindrical space 94 between the outer and inner tubular structures 88 and 90. The exhaust inlet duct 98 has an open end in the neighbourhood of the closed end wall portion of the inner tubular structure 90 and the exhaust inlet ports 96*d*, 96*e* 96*f* are located in a longitudinal half of the outer tubular structure 88 remote from the closed end wall of the outer tubular structure. On the other hand, the inner tubular structure 90 is formed with a number of openings 100 providing communication between the interior of the inner tubular structure 90 and the cylindrical space 94 between the outer and inner tubular members 88 and 90. The exhaust gases emitted from the exhaust port 84*a*, 84*b* or 84*c* of the first, second or third engine cylinder 80*a*, 80*b* or 80*c*, respectively, are thus admitted into the interior of the inner tubular member 90 through the exhaust inlet port 96*a*, 96*b* or 96*c* and the common exhaust inlet duct 98, whereas the exhaust gases emitted from the exhaust port 84*d*, 84*e* or 84*f* of the fourth, fifth or sixth engine cylinder 80*d*, 80*e* or 80*f*, respectively, first enter the cylindrical space 94 between the outer and inner tubular structures 88 and 90 through the exhaust inlet port 96*d*, 96*e* or 96*f* and are then admitted into the interior of the inner tubular structure 90 through the openings 100 formed in the inner tubular structure. The interior of the inner tubular structure 90 constitutes a re-combustion chamber of the thermal reactor 86. In the cylindrical space 94 between the outer and inner tubular structures 88 and 90 may be substantially coaxially positioned a cylindrical guide member 102 which is shown to be cantilevered at one end on the annular end wall member 92 and open at the other end. The cylindrical guide member 102 is radially spaced apart from the inner peripheral surface of the outer tubular structure 88 and the outer peripheral surface of the inner tubular structure 90 and longitudinally extends over the outlet ends of the second group of exhaust inlet ports 96*d*, 96*e* and 96*f*, terminating past the exhaust inlet port 96*d* which is located in the longitudinally central portion of the outer tubular structure 88. The openings 100 located in that longitudinal portion of the inner tubular structure 90 which is coextensive with the cylindrical guide member 92 are thus sheltered from the second group of exhaust inlet ports 96*d*, 96*e* and 96*f* and, as a consequence, the stream of the exhaust gases spurting from the exhaust inlet port 96*d*, 96*e* or 96*f* into the cylindrical space 94 will first impinge upon the outer peripheral surface of the guide member 102 and will then be deflected toward the closed end wall of the outer tubular structure 88 as indicated by arrows in FIG. 3. The guide member 102 thus serves as a deflector for the stream of the exhaust gases being passed from the second group of exhaust ports 96*d*, 96*e* and 96*f* toward the inner tubular structure 90. The inner tubular structure 90 merges at its open end into an exhaust outlet duct 104 which is vented to the open air through an exhaust pipe, a muffler or mufflers and a tail pipe (not shown).

An elongate air-injection nozzle 106 extends substantially throughout the length of the re-combustion chamber in the inner tubular structure 90, terminating close to the closed end wall portion of the inner tubular structure and supported at its leading end by a support member 108 which is secured to the end wall portion of the inner tubular structure. The elongate nozzle 106 is formed with openings 110 which are located in a longitudinal half portion of the re-combustion chamber in the inner tubular structure 90 remote from the open end of the inner tubular member 90 as shown. For the reason which will be understood later, the open end portion of the inner tubular structure 90 and part of the exhaust outlet duct 104 are surrounded by a coaxial chamber 112 from which the elongate nozzle 106 projects into the re-combustion chamber in the inner tubular structure 90.

An air-feed pump 114 has a discharge port communicating through an air-feed passageway 116 with the above-mentioned chamber 112 so that air is pumped through the passageway 116 and the chamber 112 to the air-injection nozzle 106 and is injected into the interior of the inner tubular structure 90 through the openings 110 in the nozzle 106. The air-feed passageway 116 is branched across a solenoid-operated valve 118 to a passageway 120 which is branched into air-injection nozzles 122*a*, 122*b* and 122*c* projecting into the exhaust ports 84*a*, 84*b* and 84*c* of the first, second providing heat-exchange means. The secondary air which has been warmed up in the air jacket 112 will be further heated by the hot combusted gases contacting the air-injection nozzle 106 when passing through the air-injection nozzle 106 toward the leading end portion of the nozzle formed with the openings 110. When the recombusted gases are thus being discharged out of the thermal reactor 86, exhaust gases will be discharged from the exhaust port 84*b* or 84*c* of the second or third engine cylinders 80*b* or 80*c* depending upon the firing order of the engine 80 and then from the exhaust port 84*f* of the sixth engine cylinder 80*f*. When the exhaust gases thus admitted into the re-combustion chamber are re-combusted and discharged from the re-combustion chamber, then exhaust gases will now be discharged from the remaining one of the first group of cylinders and thereafter through the remaining one of the second group of cylinders. The exhaust gases discharged from each of the first group of engine cylinders 80*a*, 80*b* and 80*c* are in this manner fired in the longitudinal end portion of the re-combustion chamber either by the heat of the exhaust gases or by means of the spark plug 138, whereas the exhaust gases discharged from each of the second group of engine cylinders 80*d*, 80*e* and 80*f* are fired mainly in the hot zone of the re-combustion chamber by the heat of the hot combusted gases flowing through the hot zone.

When, now, the engine 80 operated under low-load condition, the exhaust temperature sensor 128 detects the reduced temperature of the exhaust gases so that the engine-load responsive switch 124 closes and consequently the coils 118*a* and 136*a* of the solenoid-operated valves 118 and 136 are energized from the d.c. power source 126. The solenoid-operated valve 118 is actuated to open the air-feed passageway 120 and the solenoid-operated valve 136 actuated to open the fuel-feed passageway 132 so that secondary air is injected through the air-injection nozzles 122*a*, 122*b* and 122*c* and at the same time secondary fuel is injected through the fuel-injection nozzles 134*a*, 134*b* and 134*c* into the exhaust ports 84*a*, 84*b* and 84*c* of the previo previously mentioned first group of engine cylinders 80*a*, 80*b* and 80*c*, respectively. The secondary air and the secondary fuel thus injected into each of the exhaust ports 84*a*, 80*b* and 84*c* of the first, second and third engine cylinders 80*a*, 80 *b* and 80*c*, respectively, are admixed to the exhaust gases discharged from the exhaust port 84*a*, 84*b* or 84*c* so that the exhaust gases are partly re-combusted when entering the exhaust inlet port 96*a*, 96*b* or 96*c*, giving rise to an increase in the exhaust gases admitting into the re-combustion chamber in the inner tubular structure 90 through the exhaust inlet duct 98. Because, in this instance, the exhaust gases admitted into the recombustion chamber have been added with air in the exhaust port 84*a*, 84*b* or 84*c*, enhanced turbulent motions are achieved of the turbulent flows induced in the recombustion chamber, facilitating the mixture of the exhaust gases and the secondary air to be fired by the spark plug 138 or, where the thermal reactor 86 is not provided with the spark plug 138, by the heat possessed by the exhaust gases preliminarily partly re-combusted. The firing of the mixture will be further facilitated because of the fact that the secondary air pumped from the air-feed pump 114 is partly passed to the airinjection nozzles 122*a*, 122*b* and 122*c* and is thus injected at a reduced rate into the re-combustion chamber so that the mixture produced in the re-combustion chamber is prevented from being abruptly and excessively diluted and cooled.

If desired, air-injection nozzles communicating with the air-feed passageway 120 may be also arranged in the exhaust ports 96*d*, 96*e* and 96*f* of the previously mentioned second group of engine cylinders 80*d*, 80*e* and 80*f*, especially where the engine 80 is so designed as to operate on a relatively rich air-fuel mixture. If, conversely, the engine 80 is designed to operate on a relatively lean air-fuel mixture, the solenoid-operated valve 136 may be removed from the secondary-fuel supply arrangement so that the secondary fuel is constantly injected into each of the exhaust ports 84*a*, 84*b* and 84*c* of the first group of engine cylinders 80*a*, 80*b* and 80*c* and, if desired, also into each of the exhaust ports 84*d*, 84*e* and 84*f* of the second group of engine cylinders 80*d*, 80*e* and 80*f*.

Figure 4:
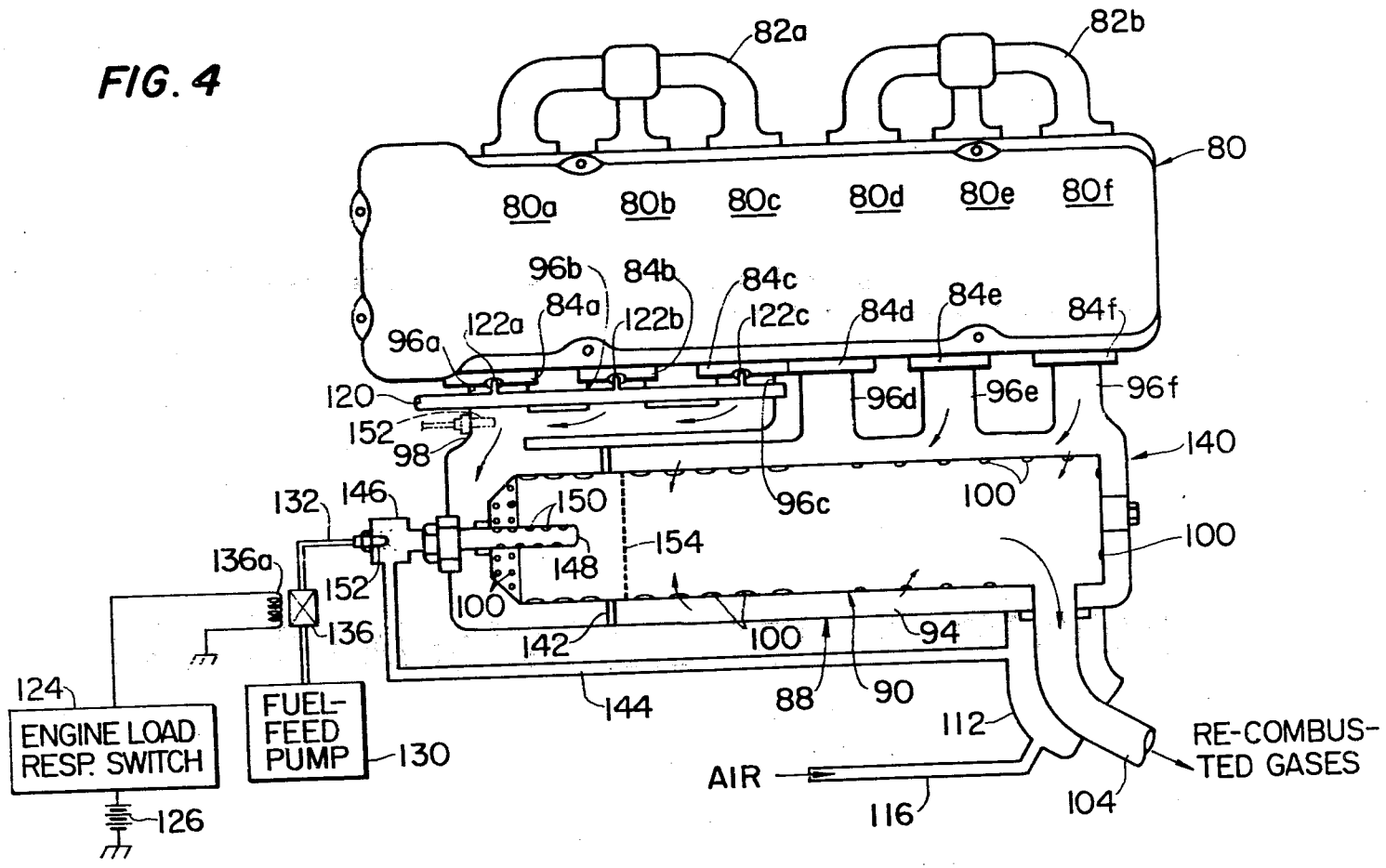
FIG. 4 is a schematic view showing, partly in section, a fourth preferred embodiment of the exhaust cleaning system according to the present invention.

As an alternative to the secondary-fuel supply arrangement in which the secondary fuel is injected directly into the exhaust gases being discharged from the exhaust port of each engine cylinder as in the embodiment illustrated in FIG. 3, the secondary fuel may be admixed to the secondary air to be injected into the re-combustion chamber in the inner tubular structure 90. FIG. 4 shows an embodiment of the exhaust cleaning system incorporating such a secondary-fuel supply arrangement.

Referring to FIG. 4, the exhaust cleaning system is shown to be also combined with the six-cylinder internal combustion engine 80. The exhaust cleaning system comprises a thermal reactor 140 which is constructed and arranged essentially similarly to the thermal reactor 86 forming part of the embodiment illustrated in FIG. 3 and which is thus composed of the outer and inner tubular structures 88 and 90. Different from the counterparts of the exhaust cleaning system shown in FIG. 3, the outer and inner tubular structures 88 and 90 of the exhaust cleaning system illustrated in FIG. 4 are so arranged as to have their longitudinal end walls spaced apart from each other so that the inner tubular structure 90 is formed with openings 100 which are located not only in the longitudinal wall portion but in the opposite end wall portions of the inner tubular structure. The exhaust inlet duct 98 leading through the exhaust inlet ports 96*a*, 96*b*, 96*c* from the exhaust ports 84*a*, 84*b* and 84*c* of the first group of engine cylinders 80*a*, 80*b* and 80*c*, respectively, is open into the longitudinal end portion of the space 94 between the outer and inner tubular structures 88 and 90. As an alternative to the cylindrical guide member or deflector 102 incorporated into the thermal reactor in the exhaust cleaning system illustrated in FIG. 3, an annular partition member 142 may be positioned between the outer and inner tubular structures 88 and 90 in the neighbourhood of the end portion of the inner tubular structure 90 adjacent to the open end of the exhaust inlet duct 98, dividing the space 94 into two separate sections one of which is in communication with the exhaust inlet duct 98 and the other of which is in communication with the exhaust inlet ports 96*d*, 96*e* and 96*f* leading from the exhaust ports 84*d*, 84*e* and 84*f* of the second group of engine cylinders 80*d*, 80*e* and 80*f*, respectively.

The inner tubular structure 90 is, furthermore, shown to be connected to the exhaust outlet duct 104 at its longitudinal portion adjacent the closed end wall portion of the inner tubular structure opposite to the open end of the exhaust inlet duct 98. The exhaust outlet duct 104 is also surrounded by the air jacket 112 which is in communication at one end with the air-feed pump (not shown) through the previously mentioned air-feed passageway 116. The air jacket 112 communicates at the other end with a passageway 144 which terminates in a mixture-forming chamber 146. The mixture-forming chamber 146 is, in turn, communicates with a nozzle 148 which projects into the longitudinal end portion of the re-combustion chamber in the inner tubular structure 90 adjacent the open end of the exhaust inlet duct 98, the nozzle 148 being formed with a number of openings 150. Into the mixture-forming chamber 146 does project a fuel-injection nozzle 152 which is in communication through the previously mentioned fuel-feed passageway 132 with the fuel-feed pump 130 across the solenoid-operated valve 136 which is controlled by the engine-load responsive switch 124. Though not shown in FIG. 4, the engine-load responsive switch 124 is also connected to another solenoidoperated valve across which the air-injection nozzles 122*a*, 122*b* and 122*c* provided in the exhaust ports 84*a*, 84*b* and 84*c* of the first group of engine cylinders 80*a*, 80*b* and 80*c*, respectively, are in communication with the air-feed pump through the passageway 120, as previously described in connection with the embodiment illustrated in FIG. 3. Designated by reference numeral 154 is a flame holder which may be positioned in the neighbourhood of the leading end of the nozzle 148 in the re-combustion chamber of the inner tubular structure 90 so as to maintain flames within a compartment defined between the flame holder 154 and the adjacent closed end wall portion of the inner tubular structure 90 when exhaust gases are fired and combusted in the compartment. The flame holder 154 is usually formed of a wire mesh of highly heat-resistive material.

During usual operation of the engine 80, the engine-load responsive switch 124 remains open so that no additional fuel is admixed to the secondary air flowing through the mixture-forming chamber 146 so that the exhaust gases entering the re-combuston chamber in the inner tubular structure 90 are only added with secondary air which is injected into the re-combustion chamber from the nozzle 148.

When, however, the engine load is reduced below a predetermined level, the engine-load responsive switch 124 is closed and actuates the solenoid-operated valve 136 so that the secondary fuel is injected from the fuel-injection nozzle 152 into the mixture-forming chamber 146. The air entering the mixture-forming chamber 146 is consequently mixed with the fuel injected from the nozzle 152 and the resultant mixture of fuel and air is injected from the nozzle 148 into the re-combustion chamber in the inner tubular structure 90. Simultaneously as the solenoid-operated valve 136, the other solenoid-operated valve forming part of the secondary-air supply arrangement is actuated by the engine-responsive switch 124 so that the secondary air is injected into each of the exhaust ports 84a, 84b and 84c of the first group of engine cylinders 80a, 80b and 80c. The exhaust gases discharged from each of the exhaust ports 84a to 84c are consequently mixed with the secondary air and partly burned when entering the exhaust inlet port 96a, 96b or 96c and the exhaust inlet duct 98. The partly burned exhaust gases then enter the space 94 between the outer and inner tubular structures 88 and 90 and are admitted through the openings 100 in the inner tubular structure 90 into the re-combustion chamber in the structure 90. The partly burned gases are mixed with the mixture of the secondary fuel and air injected from the nozzle 148 and are further burned to produce turbulent flows of hot combusted gases in the compartment defined between the flame holder 154 and the adjacent closed end wall of the inner tubular structure 90. The hot combusted gases are then caused to move through the meshed flame holder 154 toward the hot zone of the re-combustion chamber in the inner tubular structure 90 and are mixed with the exhaust gases which have been admitted into the re-combustion chamber from any one of the exhaust port 84d, 84e and 84f of the second group of engine cylinders 80d, 80e and 80f. The exhaust gases thus newly admitted into the re-combustion chamber of the inner tubular structure 90 are fired by the hot combusted gases flowing through the hot zone of the re-combustion chamber. The thus re-combusted gases are discharged from the thermal reactor 86 to the open air through the exhaust outlet duct 104.

If preferred, the fuel-injection nozzle 152 may be located in the exhaust inlet duct 98 as indicated by phantom lines in FIG. 4 so that the exhaust gases preliminarily partly burned in the exhaust port 84a, 84b or 84c of the engine cylinders 80a, 80b or 80c with the agency of the secondary air injected from the air-injection nozzle 122a, 122b or 122c are mixed with the secondary fuel before entering the re-combustion chamber in the inner tubular structure 90.

As previously mentioned in connection with the embodiment illustrated in FIG. 3, the secondary-fuel supply arrangement of the embodiment shown in FIG. 4 may be modified so that te secondary fuel is constantly admixed to the exhaust gases throughout the operation of the engine 80, especially were the engine 80 is so designed as to be supplied with a relatively lean air-fuel mixture.

The engine 80 may be otherwise designed in such a manner that a relatively rich air-fuel mixture is supplied to each of the first group of cylinders 80a, 80b and 80c and a relatively lean air-fuel mixture is supplied to the second group of cylinders 80d, 80e and 80f. Where the engine 80 is arranged in this fashion, the exhaust gases emitted from the first group of engine cylinders 80a, 80b and 80c will contain a relatively high concentration of carbon monoxide and a relatively low concentration of hydrocarbons, whereas the exhaust gases emitted from the second group of engine cylinders 80d, 80e and 80f will contain a relatively low concentration of carbon monoxide and a relatively high concentration of hydrocarbons. The relatively high concentration of carbon monoxide contained in the exhaust gases from the first group of engine cylinders will be completely oxidized through the reaction of the exhaust gases with the secondary air in the longitudinal end portion of the re-combustion chamber and the resultant hot combusted gases are effective to efficiently oxidize the carbon monoxide and hydrocarbons contained in the exhaust gases from the second group of engine cylinders. Supplying a relatively rich airfuel mixture to the first group of engine cylinders and a relatively lean air-fuel mixture to the second group of engine cylinders will also be conductive to reduction of the concentration of nitrogen oxides in the exhaust gases for the reason previously explained.

The embodiments of the exhaust cleaning system illustrated in FIGS. 3 and 4 have been described as being installed on six-cylinder internal combustion engines. It is, however, apparent that the advantages of the embodiments may also be achieved in four, eight, 12 or 16 cylinder engines if such embodiments are modified appropriately. If, for example, the four-cylinder engine of the nature illustrated in FIG. 1 or 2 is to be combined with such a modification of the embodiment illustrated in FIG. 3 or 4, the exhaust ports of the first and fifth engine cylinders should be in communication with the exhaust inlet duct 98 opening into the recombustion chamber in the inner tubular structure 90 (as in the embodiment shown in FIG. 3) or into the space 94 between the outer and inner tubular structures 88 and 90 (as in the embodiment shown in FIG. 4) and the exhaust ports of the second and third engine cylinders should be in communication with the re-combustion chamber through the openings 100 located in a downstream half of the inner tubular structure 90 as in the embodiment shown in FIG. 3 or 4, provided the four-cylinder engine is so arranged as to be fired in a sequence of the first, second, fourth and third cylinders as is usual with the four-cylinder internal combustion engines.

While several preferred embodiments of the exhaust cleaning system according to the present invention have been described and shown, such are merely for the purpose of illustration and, therefore, it should be borne in mind that the embodiments herein disclosed are subject to various modifications and changes depending upon the types of the internal combustion engines to be combined therewith and/or the desired re-combustion performances of the thermal reactors. Where desired, for example, the outer tubular structure constituting the casing of the thermal reactor may be coated with a heat-insulating material so as to be capable of more efficiently maintaining an elevated temperature in the thermal reactor. By preference, moreover, the partition members 58, 60a and 60b of each of the embodiments shown in FIGS. 1 and 2, the cylindrical guide member or deflector 102 of the embodiment shown in FIG. 3, and/or the partition member 142 of the embodiment shown in FIG. 4 may be formed with openings for allowing the exhaust gases to pass therethrough in limited quantities. The number, the sizes and/or the distribution of the openings formed in the inner tubular structure in each of the embodiments shown in FIGS. 1 to 4 should be selected to provide optimum re-combustion efficiency of the thermal reactor. If desired, all or some of these openings in the inner tubular structure of the thermal reactor may be provided in a louver form with parallel elongate slots formed in the inner tubular structure.

From the following description, it will now be understood that the exhaust cleaning system embodying the present invention provides the following advantages:

1. Since the major proportion of exhaust gases is admitted into the re-combustion chamber radially inwardly from the opening in the inner tubular structure and since the secondary air is injected into the recombustion chamber from openings located in proximity to the axis of the re-combustion chamber, the combustion of the mixture of the exhaust gases and the secondary air takes place principally in a sectionally central area of the elongate re-combustion chamber or, in other words, in an elongate zone which is radially spaced apart from the inner peripheral surface of the longitudinal wall portion of the inner tubular structure. The inner tubular structure is therefore kept from a direct attack of the hot combusted gases produced in and around such an elongate zone.

2. The exhaust gases flowing through the space between the outer and inner tubular structures contact the outer peripheral surface of the inner tubular structure and are thus effective to cool the inner tubular structure. On the other hand, the outer tubular structure will not be heated to a temperature higher than the temperature of the exhaust gases flowing through the space between the outer and inner tubular structures.

3. For the reasons explained in the above paragraphs (1) and (2), the outer and inner tubular structures need not be constructed of highly heat-resistive, massive and costly materials so that the thermal reactor will have a compact and light-weight construction which is ready to be installed on an automotive vehicle and which is economical to manufacture.

4. Because of the dynamic turbulent flows of the gases induced in the re-combustion chamber and because of the fact that the re-combustion of the exhaust gases proceeds throughout the length of the elongate recombustion chamber, the exhaust gases are caused to stay in the thermal reactor for prolonged periods of time untill they are completely re-combusted.

5. The temperature of the re-combusted gases increases progressively as the burning gases advance through the hot zone in the re-combustion chamber. The exhaust gases can therefore be kept fired even after the combustible constituents of the gases have been leaned out to such an extent as could not be fired in usual thermal reactors. This is the prime reason why the internal combustion engine combined with the exhaust cleaning system according to the present invention may be arranged to operate on a relatively lean air-fuel mixture.

6. The internal combustion engine thus operable on a relatively lean air-fuel mixture is advantageous for the reduction of nitrogen oxides in the exhaust gases as well as from the view point of fuel economy.

7. If the engine is arranged so that one half of the engine cylinders is supplied with a relatively rich air-fuel mixture and the other half supplied with a relatively lean air-fuel mixture, carbon monoxide which is more difficult to be re-burned than hydrocarbons can be completely re-xodized and, at the same time, the concentration of nitrogen oxides in the exhaust gases will be reduces significantly.

8. Where the inner tubular structure is split into two longitudinal halves which are separate from each other as in the embodiment illustrated in FIG. 1 or 2, no problem will arise from the thermal expansion of the halves.

What is claimed is:

1. An exhaust cleaning system for use with an automotive multiple-cylinder internal combustion engine including first and second groups of engine cylinders which are to be fired alternately to each other, which system comprises a thermal reactor comprising an outer elongate hollow structure formed with a first group of exhaust inlet ports communicating with the exhaust ports of said first group of engine cylinders and a second group of exhaust inlet ports communicating with the exhaust ports of said second group of engine cylinders; an inner elongate hollow structure which is positioned within said outer elongate hollow structure for forming an elongate space between the outer and inner elongate hollow structures and which is formed with a plurality of openings providing communication between said space and the interior of said inner elongate hollow structure, said interior of the inner elongate hollow structure constituting a re-combustion chamber of the thermal reactor; at least one air-injection nozzle opening in the vicinity of one longitudinal end of said re-combustion chamber and in close proximity to an axis of the inner elongate hollow structure, said first group of exhaust inlet ports being open in the neighbourhood of the longitudinal end portion of the inner elongate hollow structure adjacent said one longitudinal end of the re-combustion chamber; an outlet duct leading from said re-combustion chamber for discharging recombusted gases from the re-combustion chamber; air-supply means for feeding air to said air-injection nozzle; and guide means for guiding a stream of exhaust gases from each of said first group of exhaust inlet ports toward said longitudinal end portion of said inner elongate hollow structure and a stream of exhaust gases from each of said second group of exhaust inlet ports toward an intermediate longitudinal portion of said inner elongate hollow structure.

2. An exhaust cleaning system as claimed in claim 1, in which said guide means comprise a partition member dividing said space into a first section communicating with said first group of exhaust inlet ports and with said re-combustion chamber through the openings located in said longitudinal end portion of said inner elongate hollow structure and a second section communicating with said second group of exhaust ports and with said re-combustion chamber through the openings located in the remaining longitudinal portion of said inner elongate hollow structure.

3. An exhaust cleaning system as claimed in claim 2, in which said partition member is formed with at least one opening providing communication between said first and second sections of the space between the outer and inner elongate hollow structures.

4. An exhaust cleaning system as claimed in claim 1, in which said guide means comprise a passageway communicating at one end with said first group of exhaust inlet ports and at the other end in said re-combustion chamber.

5. An exhaust cleaning system as claimed in claim 4, in which said passageway opens in said re-combustion chamber in the vicinity of said one longitudinal end of the re-combustion chamber.

6. An exhaust cleaning system as claimed in claim 4, in which said passageway is directed tangentially of the re-combustion chamber.

7. An exhaust cleaning system as claimed in claim 4, in which said guide means further comprise a guide member positioned in said space between the outer and inner elongate hollow structures and extending around the other longitudinal end portion of the inner elongate hollow structure so that the stream of the exhaust gases from each of said second group of exhaust inlet ports is guided over an outer peripheral surface of the guide member toward said intermediate longitudinal portion of said inner elongate hollow structure.

8. An exhaust cleaning system as claimed in claim 7, in which said guide member is formed with openings.

9. An exhaust cleaning system as claimed in claim 4, in which said guide means further comprising a partition member positioned in said space between the outer and inner elongate hollow structures for dividing the space into a first section communicating with said passageway and with said re-combustion chamber through the openings located in said longitudinal end portion of the inner elongate hollow structure and a second section communicating with said second group of exhaust inlet ports and with the re-combustion chamber through the openings in the remaining longitudinal portion of the inner elongate hollow structure.

10. An exhaust cleaning system as claimed in claim 9, in which said passageway opens in said first section of the space between the outer and inner elongate hollow structures.

11. An exhaust cleaning system as claimed in claim 1, in which said air-supply means comprise an air-feed pump and an air-feed passageway leading from the air-feed pump and terminating in said air-injection nozzle.

12. An exhaust cleaning system as claimed in claim 11, in which said air-supply means further comprise a second air-feed passageway leading from said air-feed pump and opening in each of the exhaust ports of said first group of engine cylinders, and valve means disposed in said second air-feed passageway and responsive to load on the engine, said valve means being operative to close the second air-feed passageway in response to an engine load higher than a predetermined level.

13. An exhaust cleaning system as claimed in claim 12, in which said second air-feed passageway further opens in each of the exhaust ports of said second group of engine cylinders.

14. An exhaust cleaning system as claimed in claim 12, in which said air-supply means further comprise a restriction disposed in said second air-feed passageway.

15. An exhaust cleaning system as claimed in claim 1, further comprising fuel-supply means for admixing fuel to the exhaust gases to be re-combusted in said re-combustion chamber.

16. An exhaust cleaning system as claimed in claim 15, in which said fuel-supply means comprise a fuel-feed pump and a fuel-feed-passageway leading from the fuel-feed pump and opening in each of the exhaust ports of said first group of engine cylinders.

17. An exhaust cleaning system as claimed in claim 16, in which said fuel-supply means further comprise valve means disposed in said fuel-feed passageway and responsive to load on the engine, said valve means being operative to close the fuel-feed passageway in response to an engine load higher than a predetermined level.

18. An exhaust cleaning system as claimed in claim 16, in which said fuel-feed passageway further opens in such of the exhaust ports of said second group of engine cylinders.

19. An exhaust cleaning system as claimed in claim 15, in which said fuel-supply means comprise a fuel-feed pump, a mixture-forming chamber located between said air-supply means and said air-injection nozzle, a fuel-injection nozzle opening in said mixture-forming chamber and a fuel-feed passageway leading from said fuel-feed pump and terminating in said fuel-injection nozzle.

20. An exhaust cleaning system as claimed in claim 19, in which said fuel supply means further comprise valve means disposed in said fuel-feed passageway and responsive to load on the engine, said valve means being operative to close said fuel-feed passageway in response to an engine load higher than a predetermined level.

21. An exhaust cleaning system as claimed in claim 4, further comprising a fuel-feed pump, a fuel-injection nozzle opening in said passageway and a fuel-feed passageway leading from the fuel-feed pump and terminating in said fuel-injection nozzle.

22. An exhaust cleaning system as claimed im claim 21, further comprising valve means disposed in said fuel-feed passageway and responsive to load on the engine, the valve means being operative to close said fuel-feed passageway in response to an engine load higher than a predetermined level.

23. An exhaust cleaning system as claimed in claim 1, in which said inner elongate hollow structure is composed of longitudinal halves which are separate from each other.

24. An exhaust cleaning system as claimed in claim 23, in which said thermal reactor further comprises a support member which is in slidable contact with longitudinally inner end portions of said longitudinal halves of said inner elongate hollow structure.

25. An exhaust cleaning system as claimed in claim 23, in which said thermal reactor comprises a pair of said air-injection nozzles respectively opening in the vicinity of longitudinally outer ends of said halves of the inner elongate hollow structure.

26. An exhaust cleaning system as claimed in claim 23, in which said thermal reactor further comprises a partition member dividing said space between the outer and inner elongate hollow structure into a pair of longitudinal halves extending respectively over outer peripheral surfaces of said halves of said inner elongate hollow structure.

27. An exhaust cleaning system as claimed in claim 26, in which said thermal reactor further comprises a pair of partition members each dividing each of said longitudinal halves of said elongate space between the outer and inner elongate hollow structures into a first section in communication with at least one of the exhaust ports of said first group of engine cylinders and a second section in communication with at least one of the exhaust ports of said second group of engine cylinders.

28. An exhuast cleaning system as claimed in claim 23, in which said outlet duct leads from between longitudinally inner ends of said halves of said inner elongate hollow structure.

29. An exhaust cleaning system as claimed in claim 1, in which said air-injection nozzle extends substantially throughout the length of said re-combustion chamber and is formed with openings in its longitudinal end portion in the vicinity of said one longitudinal end of the re-combustion chamber.

30. An exhaust system as claimed in claim 1, further comprising heat-exchange means in contact with said outlet duct for transferring heat from the re-combusted gases flowing through the outlet duct to the heat-exchange means.

31. An exhaust cleaning system as claimed in claim 30, in which said heat-exchange means comprises a chamber surrounding at least a portion of said outlet duct and in communication at one end with said air-supply means and at the other end with said air-injection nozzle.

32. An exhaust cleaning system as claimed in claim 1, in which said thermal reactor further comprises and electric firing means positioned in the neighbourhood of said one longitudinal end of said re-combustion chamber.

33. An exhaust cleaning system as claimed in claim 32, in which said electric firing means is connected to a power source across a switch means which is responsive to load on the engine and which is operative to close in response to an engine load lower than a predetermined level.

34. An exhaust cleaning system as claimed in claim 1, in which said thermal reactor further comprises a flame holder which is positioned in the vicinity of said one longitudinal end of said re-combustion chamber for defining a compartment surrounding said air-injection nozzle between the end of the inner elongate hollow structure and the flame holder.

35. An exhaust cleaning system as claimed in claim 34, in which said flame holder is formed of a wire mesh.

36. An exhaust cleaning system as claimed in claim 1, in which said openings in said inner elongate hollow structure are at least partly in a louver form with a plurality of parallel elongate slots formed in the inner elongate hollow structure.

37. An exhaust cleaning system as claimed in claim 1, in which said outer elongate hollow structure is coated with a film of heat-insulating material.

* * * * *